United States Patent [19]

Steinberger

[11] Patent Number: 4,632,004

[45] Date of Patent: Dec. 30, 1986

[54] TREMOLO DEVICE FOR AN ELECTRIC GUITAR

[75] Inventor: Ned Steinberger, Cornwall, N.Y.

[73] Assignee: Steinberger Sound Corporation, Newburgh, N.Y.

[21] Appl. No.: 696,743

[22] Filed: Jan. 31, 1985

[51] Int. Cl.[4] ..... G10D 3/12

[52] U.S. Cl. ..... 84/313; 84/304

[58] Field of Search ..... 84/313

[56] References Cited

U.S. PATENT DOCUMENTS

| | | | |
|---|---|---|---|
| 2,972,923 | 2/1961 | Fender | 84/313 |
| 3,241,418 | 3/1966 | Fender | 84/313 |
| 3,500,711 | 3/1970 | Fender | 84/313 |
| 3,695,137 | 10/1972 | Eurich | 84/312 R |
| 4,171,661 | 10/1979 | Rose | 84/313 |
| 4,497,236 | 2/1985 | Rose | 84/298 |
| 4,512,232 | 4/1985 | Schaller | 84/313 |

FOREIGN PATENT DOCUMENTS

| | | | |
|---|---|---|---|
| 979615 | 1/1965 | United Kingdom | 84/313 |

*Primary Examiner*—Lawrence R. Franklin

*Attorney, Agent, or Firm*—Finnegan, Henderson, Farabow, Garrett & Dunner

[57] ABSTRACT

A tremolo device for an electric guitar has a base mounting plate with an open center section and a spring adjusting threaded screw projecting into the open center section, a bridge plate having a flange projecting into the open center section and having a pair of hinge pin receiving apertures for receiving hinge pins with projecting beveled edges which engage a pair of hinge posts extending from the base mounting plate, and a spring interconnecting the spring adjusting threaded screw and the depending flange.

20 Claims, 23 Drawing Figures

FIG 8
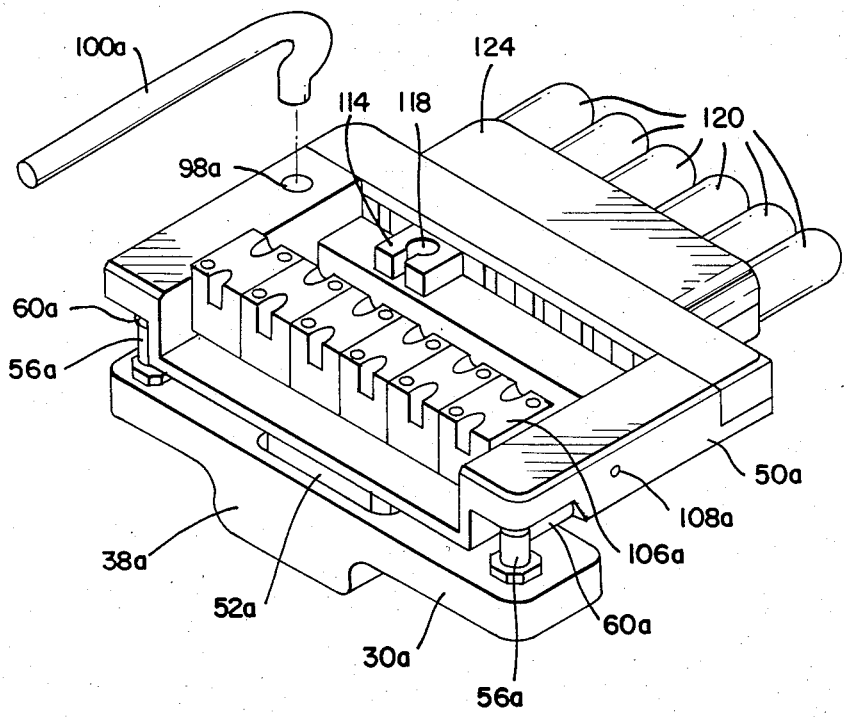
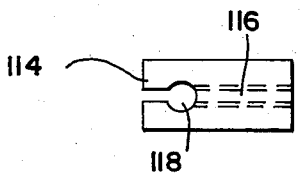
FIG 20
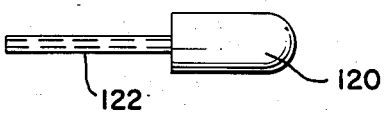
FIG 23
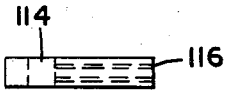
FIG 21
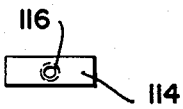
FIG 22

FIG 18
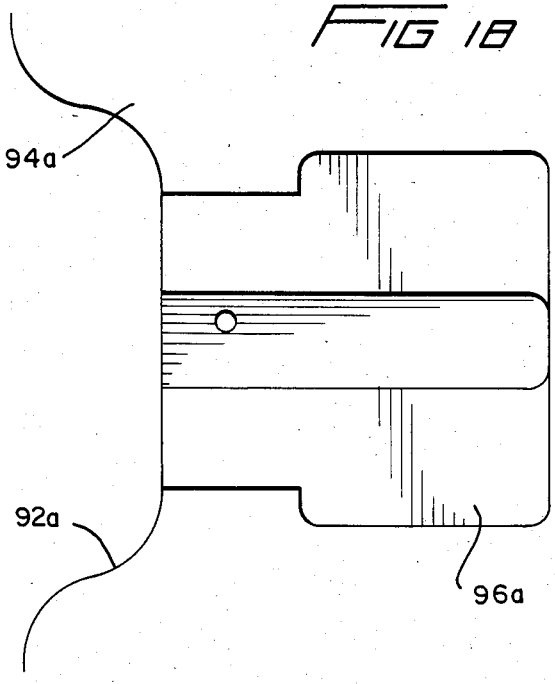
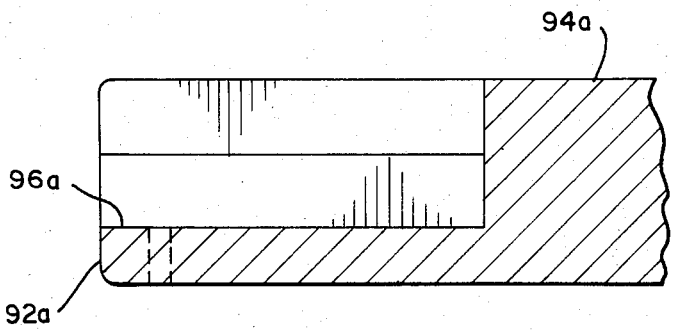
FIG 19

TREMOLO DEVICE FOR AN ELECTRIC GUITAR

BACKGROUND OF THE INVENTION

1. Field of the Invention

This invention relates to a device for producing a tremolo effect in a stringed musical instrument.

2. Description of the Prior Art

Tremolo devices have been used for many years with stringed musical instruments for creating a vibrato sound. Various structures have been proposed and utilized for this purpose.

Broadly a tremolo device provides a means for changing the tension on all of the strings of the instrument simultaneously to create a pitch change during vibration of the strings. Typically, such tremolo devices include a moving tail piece on the body of the stringed instrument that is utilized to accomplish this tension change. In such a device, a pivot point is established, and the tail piece pivots about that point to vary the tension in the strings. A counter spring is generally utilized to counteract the pull of the strings on the tail piece. A handle or actuating arm is generally provided for facilitating the pivoting of the tail piece, while simultaneously playing the instrument.

Heretofore tremolo devices have had a variety of troublesome problems. In particular, one of the most troublesome problems has been the establishment and maintenance of a satisfactory pivot point. Various knife edge pivot points have been proposed to minimize friction during pivoting of the tremolo device. An example of this arrangement is U.S. Pat. No. 4,171,661 to Floyd Rose. These prior arrangements usually suffer from the disadvantage that the knife edge becomes worn during use and requires extensive disassembly of the tail piece and replacement of a considerable portion of the tremolo device.

A second troublesome problem with the prior art tremolo devices has been the difficulty in assembling the components, installing the components on the guitar body and establishing the correct action of the device.

Accordingly, it is an object of this invention to minimize friction in a tremolo device that includes components that are easy to maintain and replace.

It is a further object of this invention to provide a tremolo device which enables a maker or user to easily and rapidly assemble and disassemble the tremolo device and mount the device on the body of a stringed instrument such as a guitar as a self-contained unit to attain the desirable tremolo action.

Additional objects and advantages of the invention will be set forth in part in the description which follows, and in part will be obvious from the description or will be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, a tremolo device is provided for a stringed instrument having a body, a neck, and a plurality of strings attached at first ends to the neck, the tremolo device comprising base mounting plate means mounted on the body and having a rearward section, a forward section and an open center section, the base mounting plate means having a threaded aperture extending through the rearward section to the open center section, a spring adjusting threaded screw inserted in the threaded aperture and having an adjusting knob on one end and spring anchor means projecting into the open center section; bridge plate means having a flange projecting therefrom into the open center section and a forward section having a pair of hinge pin receiving apertures formed therein; pivot means for pivotally mounting the bridge plate means on the base mounting plate means, the pivot means including a pair of hinge posts extending from base mounting plate means, each hinge post having an annular groove, and, a pair of hinge pins seated in the hinge pin receiving apertures, each of the hinge pins having a projecting beveled edge; and spring means for interconnecting the spring anchor means and the depending flange for urging the beveled edges of the hinge pins into the annular grooves in the hinge posts.

It is preferable that the bridge plate means includes means for releasably securing and retaining the hinge pins in the hinge pin receiving apertures. It is also preferable that the base mounting plate means include a pair of hinge post receiving apertures and means for releasably securing and retaining the hinge post in the hinge post receiving apertures.

It is further preferable that the bridge plate means includes recessed corner portions for overlying the respective hinge posts, each recessed corner portion including a surface in which one of the hinge pin receiving apertures is located.

It is additionally preferable that the hinge post including intermediate section having flat surface means for engagement with a wrench for loosening and tightening the hinge post and that the annular groove in the hinge post includes two generally conical sections which converge to form a circumferential line.

It is further preferable in the first embodiment that the body includes a tail end, a front surface, and a recessed area in the front surface extending below the front surface for accommodating the base mounting plate means, the base mounting plate means being spaced from the tail end of the body, and that the base mounting plate includes a lever means pivotally mounted on the rearward section and interposed between the spring anchor means and the spring means.

It is additionally preferable in the second embodiment that the body includes a tail end, a front surface, and a recessed area in the front surface extending below the front surface and to the tail end for accommodating the base mounting plate means, said base mounting plate means mounted adjacent the tail end of the body to position the adjusting knob beyond the tail end of the body, and that the threaded screw is mounted on the base mounting plate means so that the longitudinal extent of the threaded screw is in general alignment with the longitudinal extent of the spring means.

BRIEF DESCRIPTION OF THE DRAWINGS

The accompanying drawings, which are incorporated in and constitute a part of the specification, illustrate a preferred embodiment of the invention and, together with a general description of the invention given above in the detailed description of the preferred embodiment given below, serve to explain the principles of the invention.

FIG. 8 is a perspective view of a second embodiment of a tremolo device incorporating the teachings of the present invention;

FIG. 18 is a top plan view of a recessed section of the body of a stringed instrument to accommodate the device shown in FIG. 8;

FIG. 19 is a side elevation view and cross section of the recessed section shown in FIG. 18;

FIG. 20 is a top plan view of a tuning jaw shown in FIG. 8;

FIG. 21 is a side elevation view of the tuning jaw shown in FIG. 20;

FIG. 22 is a end view of the tuning jaw shown in FIG. 20;

FIG. 23 is a side elevation view of the tuning knob and tuning shaft shown in FIG. 8.

DESCRIPTION OF THE PREFERRED EMBODIMENTS

Reference will now be made in detail to the present preferred embodiments of the invention as illustrated in the accompanying drawings.

In accordance with the invention, the tremolo device is utilized on a stringed instrument having a body, a neck, and a plurality of strings attached at first ends to the neck.

The device comprises base mounting plate means mounted on the body and having a rearward section, a forward section, and an open center section, the base mounting plate means having a threaded aperture extending through the rearward section to the open center section, a spring adjusting threaded screw inserted in the threaded aperture and having an adjusting knob at one end and spring anchor means projecting into the open center section; bridge plate means having a flange projecting therefrom into the open center section and a forward section having a pair of hinge pin receiving apertures formed therein; spring means for interconnecting the spring anchor means and the depending flange for urging the beveled edges of the hinge pins into the annular grooves in the hinge posts.

Figure 3:
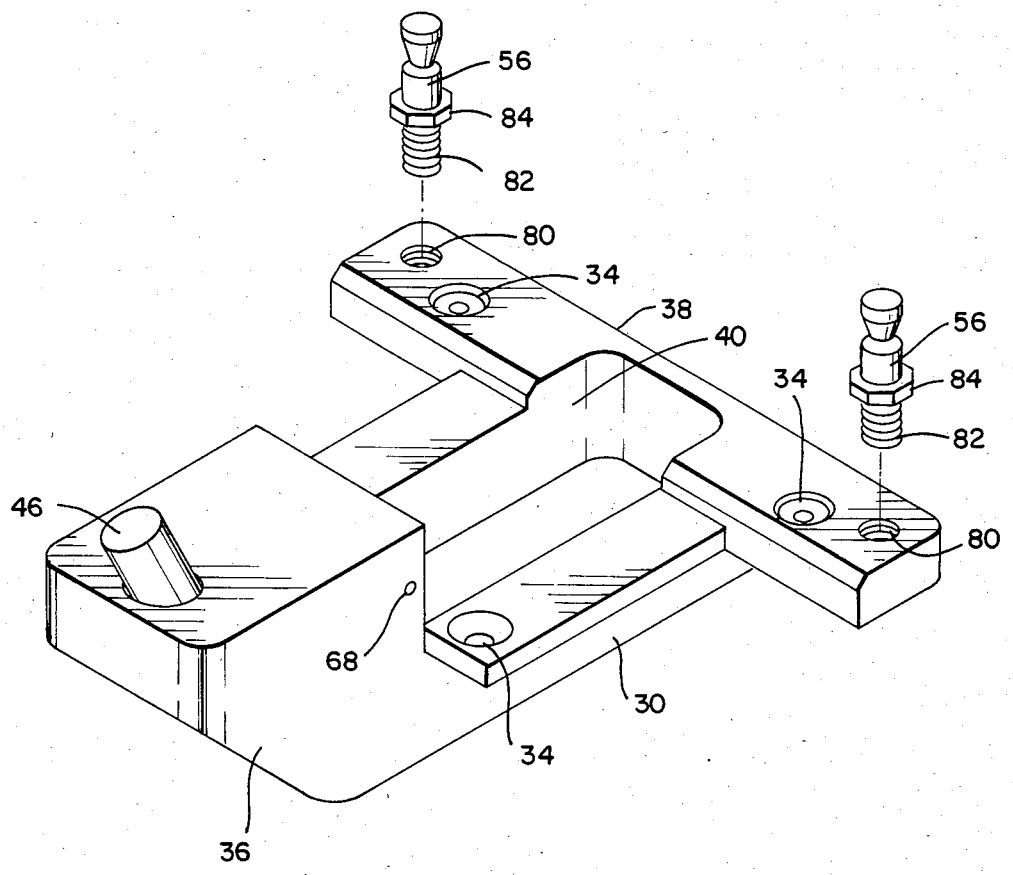
FIG. 3 is a perspective view of a bottom subassembly of the device shown in FIG. 1.
Figure 4:
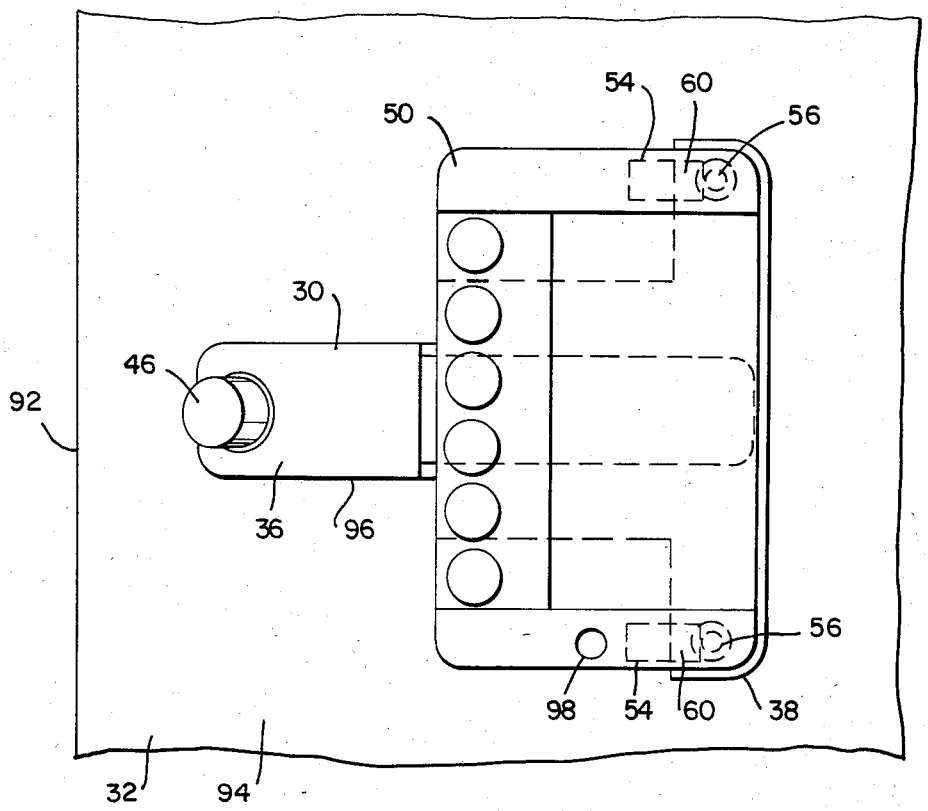
FIG. 4 is a top plan view of the device shown in FIG. 1 mounted on a body of a stringed instrument.

As here embodied, and illustratively shown as the first preferred embodiment, the base mounting plate means includes a base mounting plate 30 shown in perspective view in FIG. 3. It is mounted on the body 32 of a stringed instrument as shown in FIGS. 4 and 5 such that it lies in a recessed section of the body 32 and is fastened to body 32 by screws which are inserted into countersunk holes 34 and base mounting plate 30.

Additionally, base mounting plate 30 has a rearward section 36, a forward section 38 and an open center section 40 which includes a recessed channel area.

Figure 5:
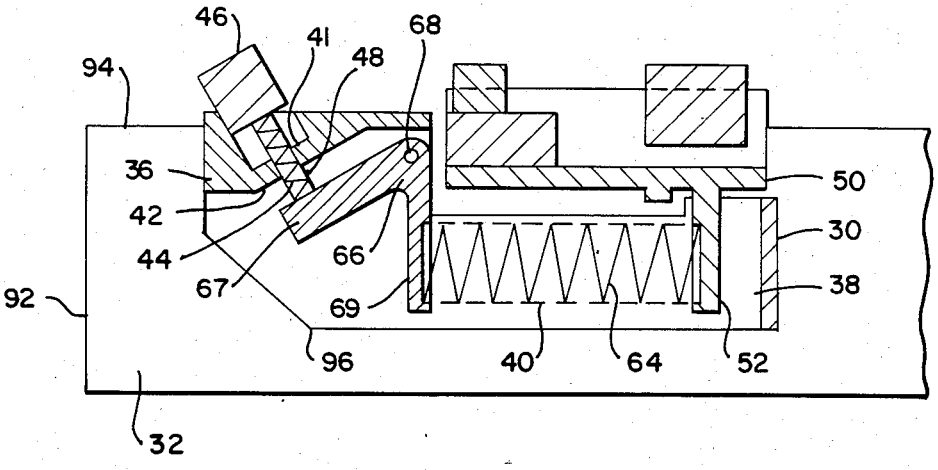
FIG. 5 is a side elevation view in cross section of the device shown in FIG. 1 mounted on the body of the stringed instrument.
Figure 6:
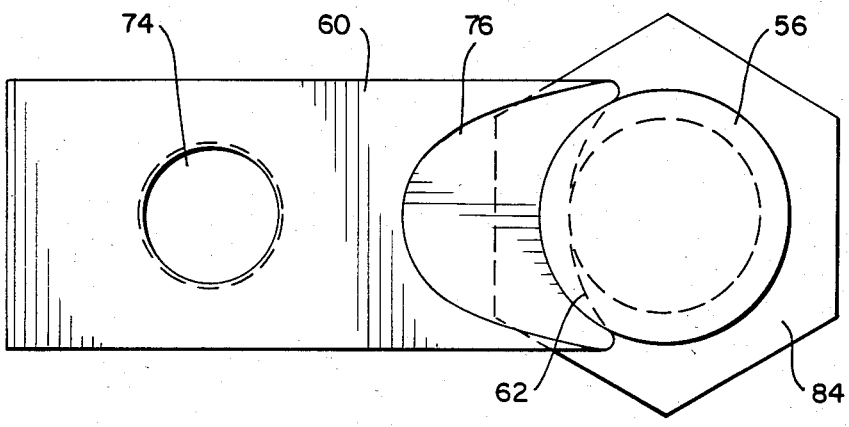
FIG. 6 is a top view of a pivot means of the device shown in FIG. 1.

As seen in FIG. 5, base mounting plate 30 has a threaded aperture 42 extending through rearward section 36 to open center section 40. A spring adjusting threaded screw 44 is inserted in the threaded aperture 42 and has an adjusting knob 46 on one end and spring anchor means such as a second end 48 projecting into the open center section.

Figure 1:
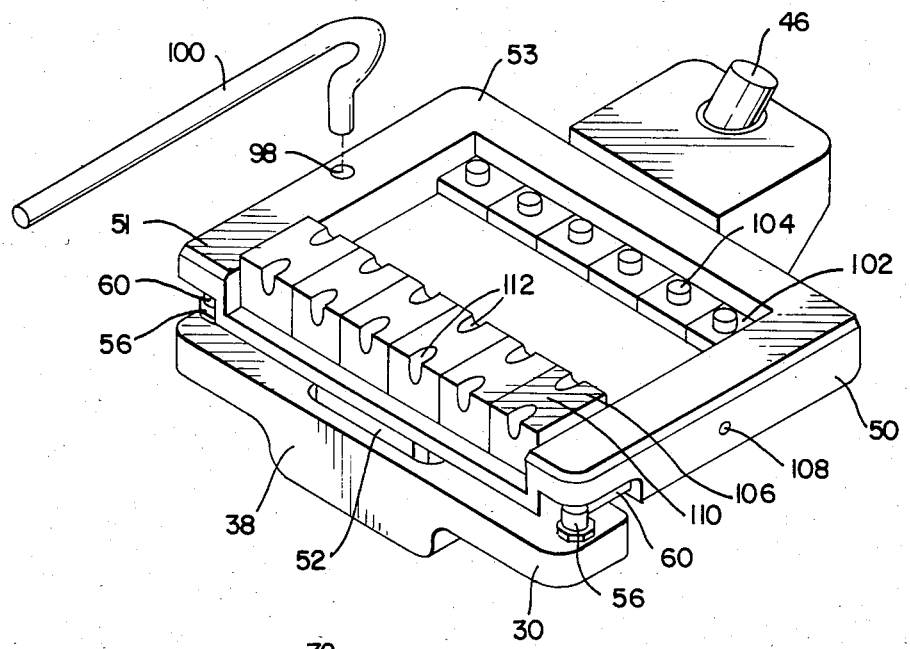
FIG. 1 is a perspective view of a first embodiment of a tremolo device incorporating the teachings of the present invention.
Figure 2:
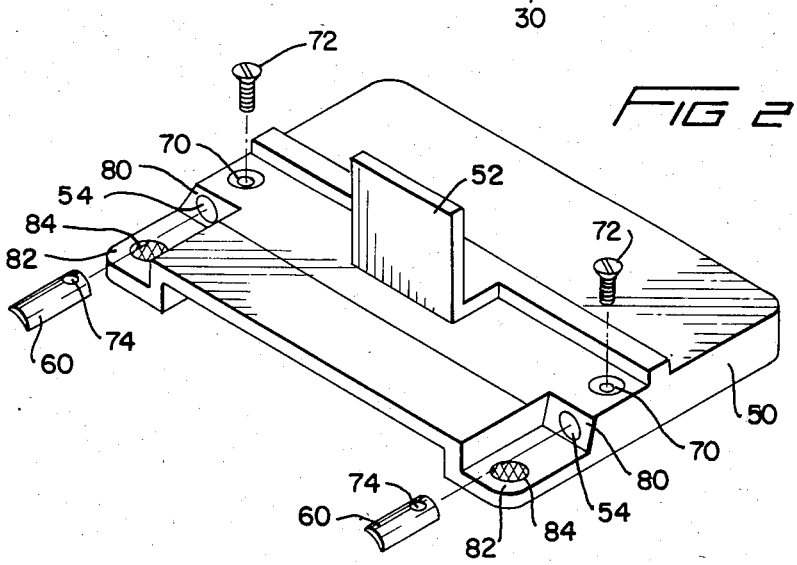
FIG. 2 is a perspective view of the underside of an upper subassembly of the tremolo device shown in FIG. 1.
Figure 7:
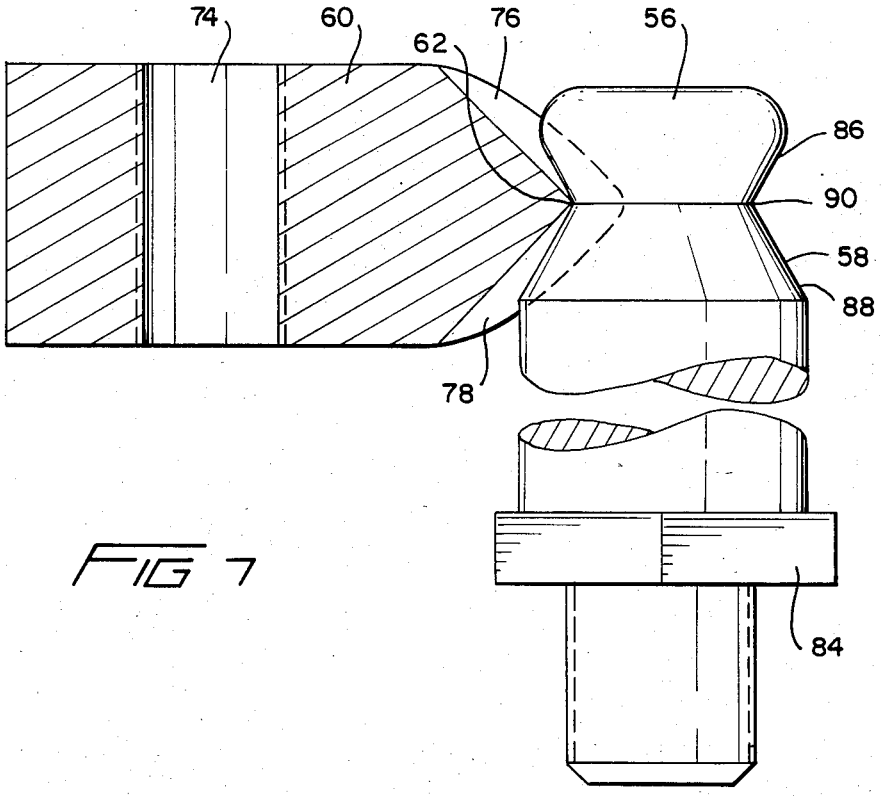
FIG. 7 is a side elevation view of the pivot means of the device shown in FIG. 6.
Figure 9:
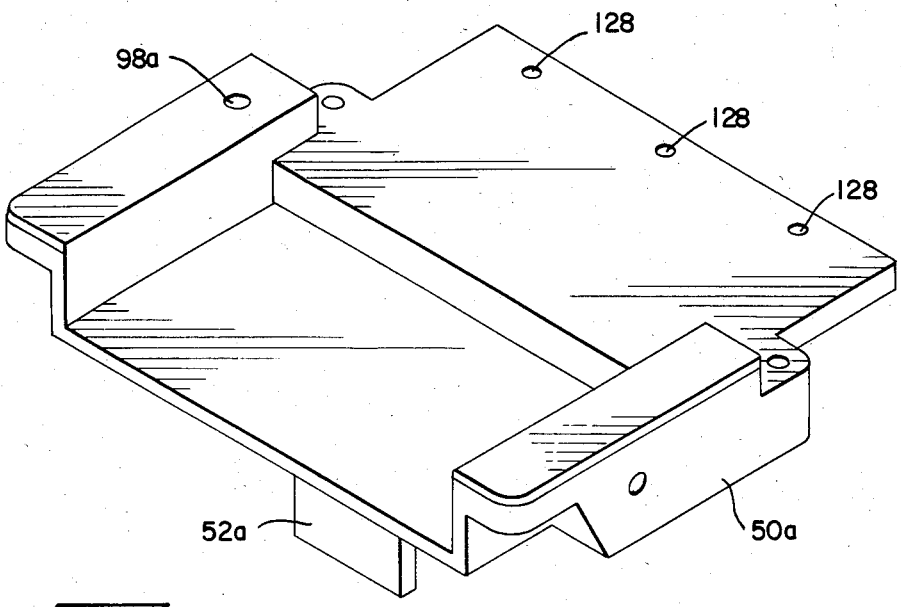
FIG. 9 is a perspective view of a main portion of a top subassembly of the device shown in FIG. 8.
Figure 10:
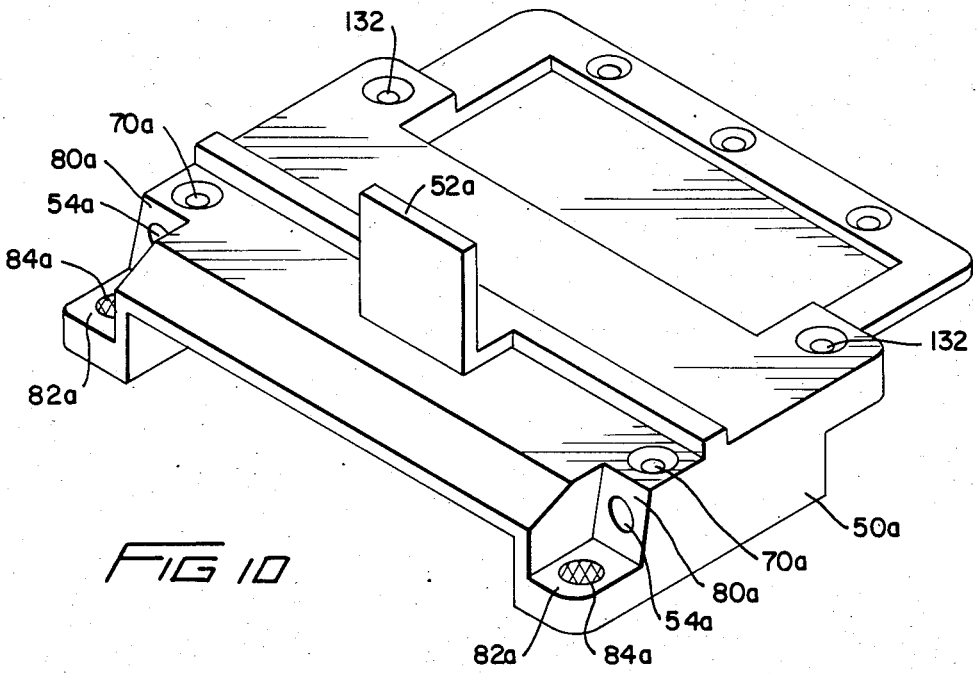
FIG. 10 is a perspective view of the underside of the subassembly shown in FIG. 9.

As here embodied, the bridge plate means includes a bridge plate 50 shown in FIG. 2 which is assembled to base mounting plate 30 as best shown in FIGS. 1 and 5. Bridge plate 50 has a flange 52 projecting therefrom into the open center section as shown in FIG. 5. Bridge plate 50 also has a pair of hinge pin receiving apertures 54 as shown in FIGS. 2 and 4. As here embodied, the pivot means for pivotally mounting bridge plate 50 on base mounting plate 30 includes a pair of hinge posts 56 extending from base mounting plate 30. As shown in FIG. 7, each hinge post 56 has an annular groove 58. The pivot means also includes a pair of hinge pins 60 seated in the hinge pin receiving apertures 54. Each hinge pin 60 has a projecting beveled edge 62. As here embodied, the spring means for interconnecting the spring anchor means such as second end 48 and the depending flange 52 includes a coil spring 64 which is compressibly loaded.

In accordance with the first embodiment of the present invention, base mounting plate 30 includes a lever means pivotally mounted on the rearward section and interposed between the spring anchor means and the spring means.

As here embodied, base mountinq plate 30 includes a lever means such as V-shaped lever 66 pivotally mounted by axle 68 on rearward section 36 of base mounting plate 30. V-shaped lever 66 is interposed between the spring anchor means such as second end 48 of spring adjusting threaded screw 44 and the spring means such as coil springs 64. Therefore, coil spring 64 interconnects second end 48 of threaded screw 44 and depending flange 52 in cooperation with V-shaped lever 66 for urging the beveled edges 62 of hinge pins 60 into the annular grooves 58 of hinge posts 56.

In accordance with the invention, the bridge plate means includes means for releasably securing and retaining the hinge pins in the hinge pin receiving apertures. As here embodied, the means for releasably securing and retaining the hinge pins includes a pair of first set screw receiving holes 70 respectively intersecting hinge pin receiving apertures 54, and further comprises set screws 72 seated in the first set screw receiving holes 70 for securing hinge pins 60 in position. First set screw receiving holes 70 are countersunk to accommodate complementary heads on set screws 72.

Each hinge pin 60 includes a second set screw receiving hole 74 so that set screws 72 are additionally seated in second set screw receiving holes 74 for locking hinge pins 60 in position. The second set screw receiving holes 74 include a threaded portion complementary to set screw 72. As shown in FIG. 7, second set screw receiving holes 74 preferably extend completely through hinge pins 60 and are threaded along their full extent.

Hinge pins 60 are generally circular in cross section for ease of construction and assembly to circular hinge pin receiving apertures 54. Each hinge pin 60 preferably is constructed from hardened steel in which beveled edge 62 includes upper beveled portion 76 and lower beveled portion 78 which are formed preferably through the use of a grinding wheel.

In accordance with the present invention, the bridge plate means includes recessed corner portions for overlying the respective hinge posts, each recessed corner portion including a surface in which one of the hinge pin receiving portions is located. As here embodied, FIG. 2 shows recessed corner portions, each having a first surface 80 in which a hinge pin receiving aperture 54 is located and a second surface 82 overlying hinge posts 56 in the manner shown in FIG. 1 and also having a concave dome area 84 to clear the underlying hinge posts 56.

In accordance with the present invention, the base mounting plate 30 includes a pair of hinge post receiving apertures 80 and means for releasably securing and retaining the hinge posts in the hinge post receiving apertures 80. As here embodied, the means for releasably securing and retaining the hinge posts include threaded aperture means such as threads in hinge post receiving apertures 80 for accommodating the threaded lower end 82 of hinge posts 56.

In accordance with the present invention, hinge posts 56 include an intermediate section having flat surface means for engagement with a wrench for loosening and tightening the hinge posts. As here embodied, the intermediate section having flat surface means includes an hexagonally shaped portion 84 which is integral with hinge posts 56 and which is engageable with a conventional wrench. Annular groove 58 includes two generally conical sections 86 and 88 which converge to form a circumferential line 90. Beveled edge 62 fits against circumferential line 90 to define a pivot point.

In accordance with the first embodiment of the present invention, the body of the stringed instrument includes a tail end, a front surface, and a recessed area in the front surface extending below the front surface for accommodating the base mounting plate means, the base mounting plate means being spaced from the tail end of the body. As here embodied, and shown in FIGS. 4 and 5, the first embodiment preferably includes an arrangement in which body 32 includes a tail end 92 opposite the body portion to which the neck is connected. Body 32 also includes a front surface 94 which is the surface over which the strings extend and through which the tremolo device is mounted. Body 32 also includes a recessed area 96 in front surface 94 extending below front surface 94 for accommodating base mounting plate 30 so that base mounting plate 30 is spaced from the tail end 92 of body 32.

As shown in FIG. 1, bridge plate 50 is provided with an aperture 98 to accommodate an actuator arm 100 for pivoting bridge plate 50 to vary the tension of the strings to produce a tremolo effect. As further shown in FIG. 1, bridge plate 50 is provided with means to secure the second end of the strings such as string anchors 102. For example, if the strings have a loop at their second end, string anchors 102 would have a complementary peg portion 104 around which the string may be looped.

In addition, bridge plate 50 preferably includes bridge saddles 106 which are positionable relative to one another and are secured in position by set screw 108. Bridge saddles 106 have a raised center portion 110 defined by aligned recesses 112 so that raised portion 110 defines an end of the vibrating portion of the string.

A second embodiment of the present invention is shown in FIGS. 8–19. Numerals followed by an "a" are used to identify elements which correspond with elements of the first embodiment described above and identified by similar numerals. The remaining distinctive portions of the second embodiment are discussed below. The first embodiment of the invention is particularly useful in arrangements in which the tuning pegs are located on the neck of the stringed instrument whereas the second embodiment is particularly useful in arrangements in which the tuning pegs are located proximate to the end of the strings which are attached to the body of the stringed instrument.

In particular, the view of the second embodiment shown in FIG. 8 corresponds to the view of the first embodiment as shown in FIG. 1. However, instead of fixed string anchors 102, the second embodiment includes movable tuner jaws 114 which are also shown in various views in FIGS. 20, 21, and 22. Tuner jaws 114 include a threaded aperture 116 and a keyhole shaped recessed portion 118. Keyhole shaped recessed portion 118 accommodates a fixture such as a ball on the end of a string so that the string may be connected to tuning jaw 114. As shown in FIG. 23, tuning knob 120 is connected to tuning jaw 114. As shown in FIG. 23, tuning knob 120 is connected to threaded tuning shaft 122. In the assembled position, threaded tuning shaft 122 is accommodated by threaded aperture 116 in tuner jaws 114 for relatively positioning tuner jaws 114 relative to tuning knob 120.

Figure 11:
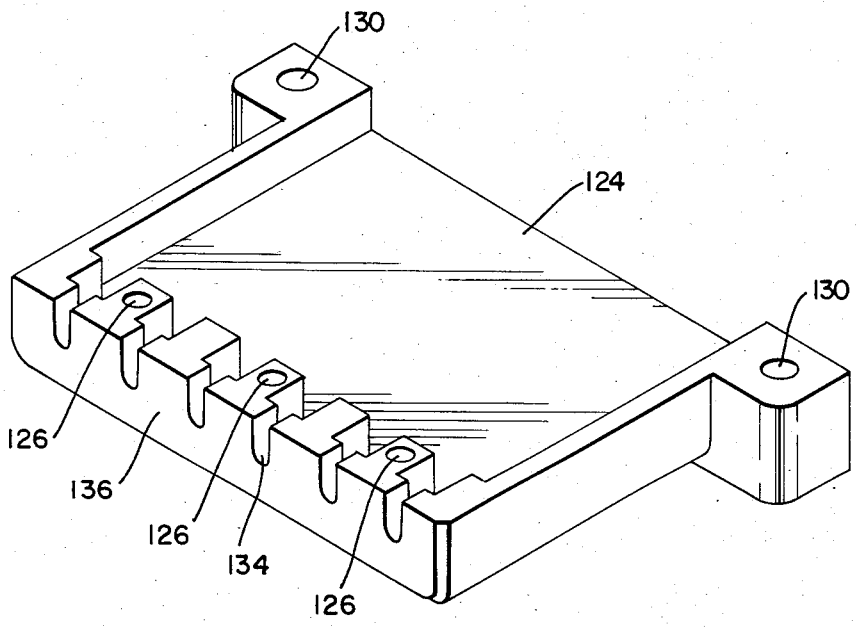
FIG. 11 is a perspective view of the underside of a portion of a top subassembly shown in FIG. 8.
Figure 12:
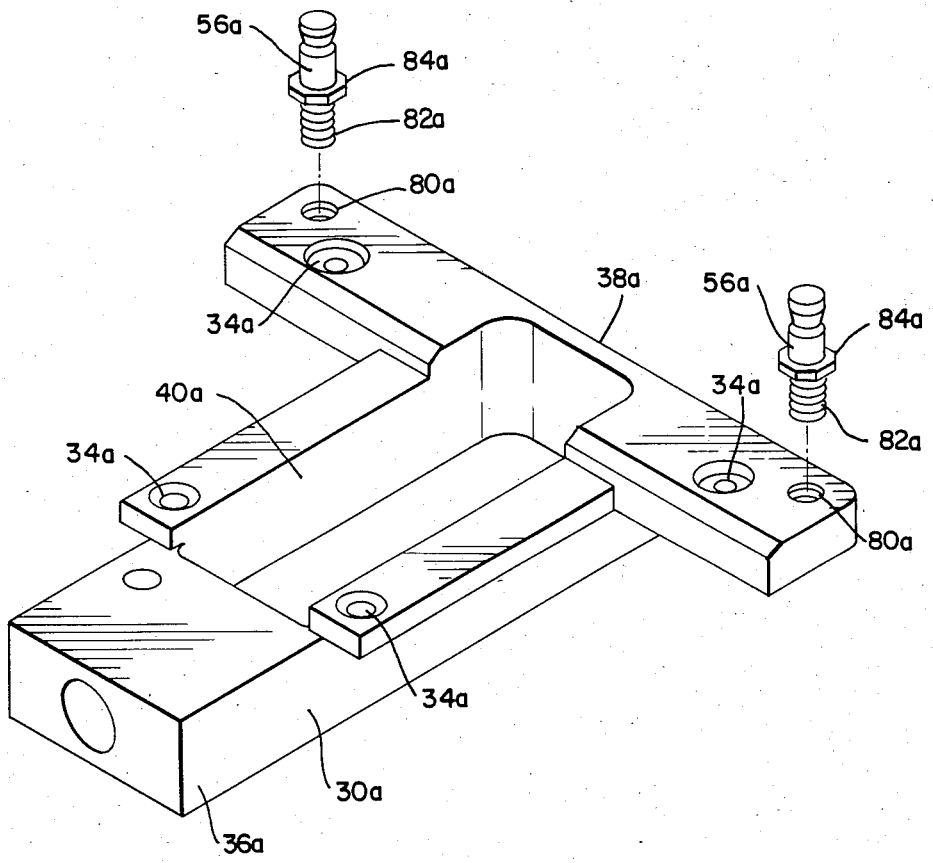
FIG. 12 is a perspective view of a bottom subassembly of the device show FIG. 8.

The second embodiment also includes tuner cover 124 which covers a portion of bridge plate 50*a*. The underside of tuner cover 124 is shown in FIG. 11 with threaded mounting holes 126 which are aligned with mounting holes 128 to receive threaded screws for mounting tuner cover 124 on bridge plate 50*a*. Similarly, threaded apertures 130 on tuner cover 124 are aligned with apertures 132 in bridge plate 50*a* to receive threaded fasteners for securing tuner cover 124 to bridge plate 50*a*. In the assembled position, tuning shaft 122 rests in grooves 134 in tuner cover 124 so that knob 120 is located proximate to tuner cover end 136.

Figures 13, 14:
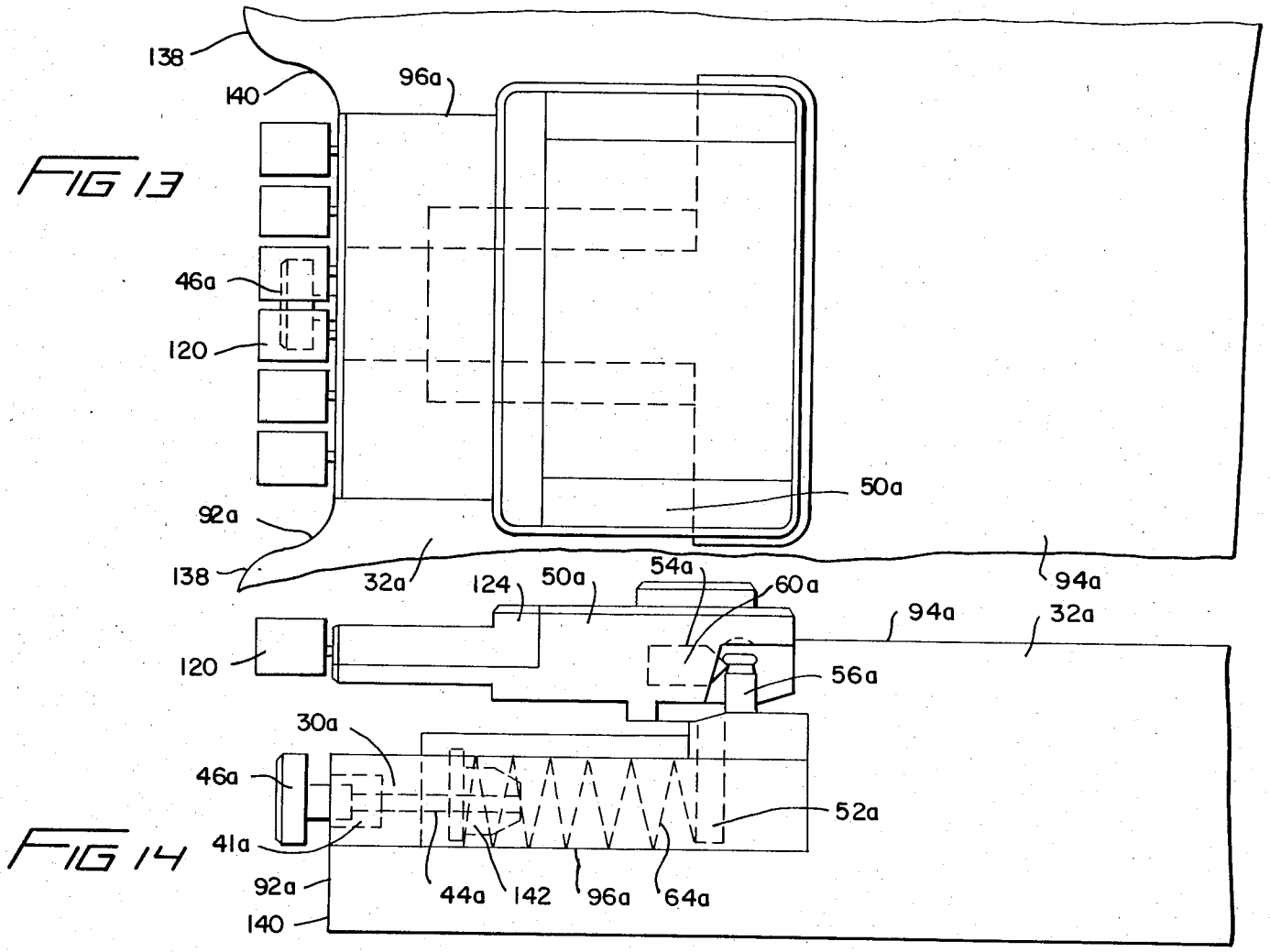
FIG. 13 is a top plan view of the device shown in FIG. 8.
FIG. 14 is a side elevation view of the portion of the device shown in FIG. 8.
Figure 15:
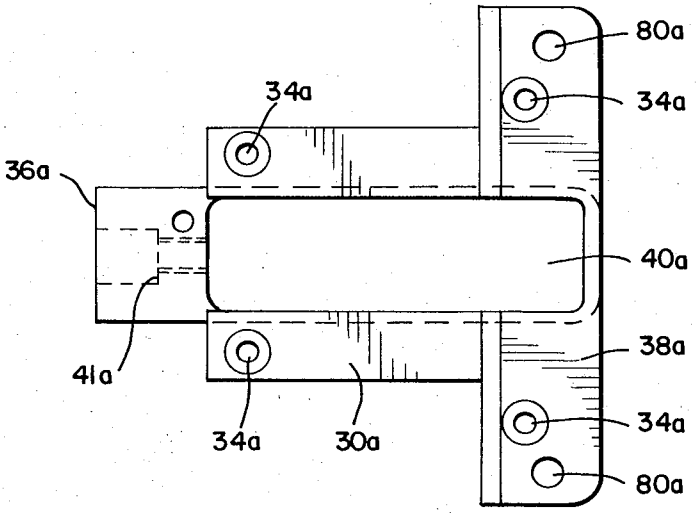
FIG. 15 is a top plan view of the lower subassembly in FIG. 8.
Figure 16:
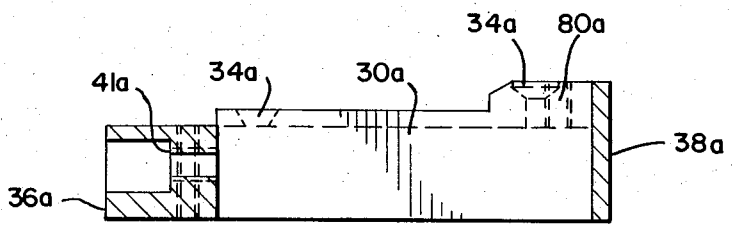
FIG. 16 is a side elevation view and partial cross section of the lower subassembly shown in FIG. 15.
Figure 17:
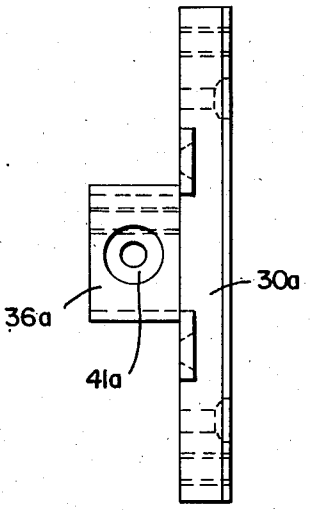
FIG. 17 is an end view of the lower subassembly shown in FIG. 15.

As shown in FIG. 14, spring adjusting threaded screw 44*a* is mounted on base mounting plate 30*a* so that the longitudinal extent of threaded screw 44 is in general alignment with the longitudinal extent of spring means such as coil spring 64*a*. In addition, in the second embodiment, body 32*a* includes a recessed area 96*a* extending below front surface 94*a* into tail end 92*a* for accommodating base mounting plate means such as base mounting plate 30 so that base mounting plate 30 is mounted adjacent tail end 92*a* of body 32*a* to position adjusting knob 46A beyond tail end 92*a* of body 32*a*.

In addition, tuning knobs 120 are positioned beyond tail end 92*a* of body 32*a*. It is preferable that body 32*a* includes a tail end 92*a* which has side areas 138 which extend past center area 140 in which the tremolo device is mounted. In this way, tuning knobs 120 and spring adjust knob 46*a* are protected when the stringed instrument is placed on its tail end 92*a*.

As seen in FIG. 14, the spring anchor means of the second embodiment includes a bushing 142 mounted on spring adjusting threaded screw 44*a* for engagement with coil spring 64*a*.

The operation of each embodiment involves the manipulation of actuating arm 100 or 100*a* in a conventional manner to cause pivoting of bridge plate 50 or 50*a* about the pivot point defined by hinge pins 60 or 60*a* and hinge posts 56 or 56*a*. The counter-balancing force exerted by coil spring 64 or 64*a* can be varied by rotating adjusting knob 46 or 46*a* to either further compress or relax spring 64 or 64*a* and therefore either increase or decrease the force upon flange 52 or 52*a*.

The preferred embodiments of the present invention includes a base mounting plate 30 which is in the form of a base housing that is self-contained and which easily can be bolted as a unit to the instrument body 32. In addition, it is seen that bridge plate 50 is easily assembled to and disassembled from to base mounting plate 30. Also, when the strings are not in place, the tremolo device stays intact as a unit. It is further seen that in the preferred embodiment, hinge posts 56 and hinge pins 60 are easily removable and replaceable after becoming worn.

Also in accordance with the first embodiment of the present invention there is provided a tremolo device for a guitar having a body, a neck extending from the body and a set of strings adjustably secured at first ends to the neck, which comprises a base housing for engagement with the guitar body, the housing having an open interior and a wall section facing outward from the guitar body; a lever means pivotally mounted within the housing, lever means having a first section and second lever section; an adjustable screw extending through the wall section to engage the first lever section; a bridge means having a forward section and a rearward section, means for attachment to second ends of the strings, saddle means for pressing against the strings, and a flange extending downwardly from the bridge means; means for pivotally mounting the bridge means on the base housing with the flange extending into the open interior of the housing; a spring interposed between the flange and the second lever section for urging the flange to bias the bridge means toward the base housing; and an actuator arm extending from the bridge means for pivoting the bridge means to vary the tension of the strings to produce a tremolo effect.

As embodied herein, the base housing includes an integral arrangement such as base mounting plate 30 shown in FIGS. 1, 3 and 5 and having an open interior such as open center section 40 shown in FIG. 3. In addition, the wall section facing outward from the guitar body includes wall section 41 which is facing outwardly from top surface 94 as opposed to rearwardly as is the analogous component 41*a* in the second embodiment which faces rearwardly from tail end 92*a*.

The lever means includes a V-shaped lever 66 having a first lever section 67 and a second lever 69. The adjustable screw includes spring adjusting threaded screw 44 which extends through wall section 41 to engage the first lever section 67.

The bridge means includes bridge plate 50 which has a forward section 51 and a rearward section 53 as shown in FIG. 1. The means for attachment to second ends of strings includes string anchors 102 with peg portion 104 and the saddle means includes bridge saddles 106.

The means for pivotally mounting the bridge means on the base housing include hinge posts 56 and hinge pins 60 and the spring interposed between flange 52 and second lever section 69 includes coil springs 64.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of applicant's general inventive concept.

What is claimed is:

1. A tremelo device for a stringed instrument having a body, a neck, and a plurality of strings attached at first ends to the neck, which comprises:

base mounting plate means mounted on the body and having a rearward section, a forward section and an open center section, said base mounting plate means having a threaded aperture extending through said rearward section to said open center section, a spring adjusting threaded screw inserted in said threaded aperture and having an adjusting knob on one end and spring anchor means projecting into said open center section;

bridge plate means having a flange projecting therefrom into said open center section and a forward section having a pair of hinge pin receiving apertures formed therein;

pivot means for pivotally mounting said bridge plate means on said base mounting plate means, said pivot means including a pair of hinge posts extending from said base mounting plate means, each hinge post having an annular groove, and a pair of hinge pins seated in said hinge pin receiving apertures, each of said hinge pins having a projecting beveled edge; and spring means for interconnecting said spring anchor means and said depending flange for urging said beveled edges of said hinge pins into said annular grooves in said hinge posts.

2. The tremolo device of claim 1 wherein the bridge plate means includes means for releasably securing and retaining the hinge pins in the hinge pin receiving apertures.

3. The tremelo device of claim 2 wherein the means for releasably securing and retaining the hinge pins includes a pair of first set screw-receiving holes respectively intersecting said hinge pin receiving apertures, and further comprising set screws seated in said first set screw-receiving holes for securing said hinge pins in position.

4. The tremolo device of claim 3 wherein each of the hinge pins include a second set screw receiving hole, said set screws additionally seated in said second set screw receiving holes for locking said hinge pins in position.

5. The tremolo device of claim 4 wherein the second set screw receiving hole includes a threaded portion complementary to the set screws.

6. The tremelo device of claim 1 wherein the hinge pins are generally circular in cross section.

7. The tremolo device of claim 1 wherein the beveled edge includes upper and lower bevel portions defining a knife edge.

8. The tremolo device of claim 1 wherein the bridge plate means includes recessed corner portions for overlying the respective hinqe posts, each recessed corner portion includinq a surface in which one of the hinge pin receiving apertures is located.

9. The tremolo device of claim 1 wherein the base mounting plate means includes a pair of hinge post receiving apertures and means for releasably securing and retaining the hinge posts in the hinge post receiving apertures.

10. The tremolo device of claim 9 wherein the lower end of each hinge post is threaded.

11. The tremolo device of claim 10 wherein the means for releasably securing and retaining the hinge posts include threaded aperture means for accommodating the lower end of each hinge post.

12. The tremolo device of claim 9 wherein the hinge posts include an intermediate section having flat surface means for engagement with a wrench for loosening and tightening the hinge posts.

13. The tremolo device of claim 1 wherein the annular groove includes two generally conical sections which converge to form a circumferential line.

14. The tremolo device of claim 1 wherein the base mounting plate includes a lever means pivotally mounted on the rearward section and interposed between said spring anchor means and said spring means.

15. The tremolo device of claim 14 wherein the lever means is generally V shaped.

16. The tremolo device of claim 14 wherein the body includes a tail end, a front surface, and a recessed area in the front surface extending below the front surface for accommodating the base mounting plate means, said base mounting plate means being spaced from said tail end of the body.

17. The tremolo device of claim 1 wherein the body includes a tail end, a front surface, and a routed area in the front surface extending below the front surface and to the tail end for accommodating the base mounting plate means, said base mounting plate means mounted adjacent the tail end of the body to position the adjusting knob beyond the tail end of the body.

18. The tremolo device of claim 17 wherein the threaded screw is mounted on the base mounting plate means so that the longitudinal extent of the threaded screw is in general alignment with the longitudinal extent of the spring means.

19. A tremolo device for a guitar having a body, a neck extending from the body and a set of strings adjustably secured at first ends to the neck, which comprises:

a base housing for engagement with the guitar body, said housing having an open interior and a wall section facing outward from the guitar body;

a lever means pivotally mounted within said housing, said lever means having a first section and a second lever section;

an adjustable screw extending through said wall section to engage said first lever section;

a bridge means having a forward section and a rearward section, means for attachment to second ends of said strings, saddle means for pressing against the strings, and a flange extending downwardly from said bridge means;

means for pivotally mounting said bridge means on said base housing with said flange extending into said open interior of said housing;

a spring interposed between said flange and said second lever section for urging said flange to bias said bridge means toward said base housing; and an actuator arm extending from said bridge means for pivoting said bridge means to vary the tension of the strings to produce a tremolo effect.

20. A tremolo as defined in claim 19, wherein said lever sections are joined at a vertex section and extend outwardly in a V-shaped configuration, and means for pivotally mounting said lever sections at the vertex section.

* * * * *